United States Patent [19]

Shtarkman

[11] Patent Number: 4,992,190

[45] Date of Patent: Feb. 12, 1991

[54] FLUID RESPONSIVE TO A MAGNETIC FIELD

[75] Inventor: Emil M. Shtarkman, Southfield, Mich.

[73] Assignee: TRW Inc., Lyndhurst, Ohio

[21] Appl. No.: 411,029

[22] Filed: Sep. 22, 1989

[51] Int. Cl.[5] ..... H01F 1/28

[52] U.S. Cl. ..... 252/62.52; 252/62.51; 252/78.3; 252/572

[58] Field of Search ..... 252/62.52, 62.51, 572, 252/573, 74, 75, 78.3

[56] References Cited

U.S. PATENT DOCUMENTS

| | | | |
|---|---|---|---|
| 2,661,596 | 12/1953 | Winslow | 60/326 |
| 2,661,825 | 12/1953 | Winslow . | |
| 2,663,809 | 12/1953 | Winslow | 310/78 |
| 2,886,151 | 5/1959 | Winslow | 192/21.5 |
| 3,047,507 | 7/1962 | Winslow . | |
| 3,221,849 | 12/1965 | Klass et al. | 192/21.5 |
| 3,250,726 | 5/1966 | Martinek et al. | 423/338 |
| 3,385,793 | 5/1968 | Klass et al. . | |
| 4,645,614 | 2/1987 | Goossens et al. | 252/75 |
| 4,668,417 | 5/1987 | Goossens et al. | 252/75 |

OTHER PUBLICATIONS

"Further Development of the NBS Magnetic Fluid Clutch", NBS Technical News Bulletin, vol. 34, p. 169 (1950).

Co-pending application Ser. No. 372,293, filed Jun. 27, 1989, assigned to the assignee of the present application.

Brochure published by GAF Corporation of Wayne, N.J. containing the code 1M-785, captioned "Carbonyl Iron Powders".

"Some Properties of Magnetic Fluids", J. D. Coolidge, Jr. and R. W. Halberg, AIEE Transactions, Paper 55-170 (Feb. 1955), pp. 149-152.

"The Magnetic Fluid Clutch", Jacob Rabinow, NBS Tech. Rep. No. 1213 (1948) [also, Trans. Amer. Inst. Elec. Eng. Preprint 48-238 (1948)].

"The Magnetic Fluid Clutch", S. F. Blunden, The Engineer, 191, 244 (1951).

"Further Development of the NBS Magnetic Fluid Clutch", NBS Tech. News Bull., 34, p. 168 (1950).

*Primary Examiner*—Prince E. Willis

*Assistant Examiner*—Christine A. Skane

*Attorney, Agent, or Firm*—Tarolli, Sundheim & Covell

[57] ABSTRACT

A rheological fluid composition which is responsive to a magnetic field. The composition comprises magnetizable particulate, silica gel as a dispersant and a vehicle. A preferred magnetizable particulate is insulated, reduced carbonyl iron.

11 Claims, 4 Drawing Sheets

FLUID RESPONSIVE TO A MAGNETIC FIELD

BACKGROUND OF THE INVENTION

1. Technical Field

The present invention relates to a rheological fluid which is responsive to a magnetic field.

2. Background Art

Rheological fluids which are responsive to a magnetic field are known. Rheological fluids responsive to an electric field are also known. Such fluids are used in clutches, shock absorbers, and other devices. A characteristic of these rheological fluids is that, when they are exposed to the appropriate energy field, solid particles in the fluid move into alignment and the ability of the fluid to flow is substantially decreased.

Electric field responsive fluids and magnetic field responsive fluids include a vehicle, for instance a dielectric medium, such as mineral oil or silicone oil, and solid particles. Examples, of solid magnetic particles which have been heretofore proposed for use in a magnetic field responsive fluid are magnetite and carbonyl iron. The fluid also may contain a surfactant to keep the solid particles in suspension in the vehicle.

Silica gel is a form of silica which is very porous and thus has a large surface area. Silica gel is frequently used in electroviscous fluids which are responsive to an electric field, as the solid which is field-responsive.

U.S. Pat. No. 3,385,793 discloses an electroviscous fluid which is conductive. The fluid includes 30%–55% silica gel and 25%–35% silicone oil which functions as a vehicle. The fluid can also contain 1%–40% iron particles disclosed to function as a conductive agent. The composition is not described as one responsive to an electromagnetic field.

Other U.S. patents disclosing the use of silica gels in electroviscous fluids are U.S. Pat. Nos. 3,047,507; 3,221,849; 3,250,726; 4,645,614; and 4,668,417.

U.S. Pat. No. 2,661,825 disclose both ferromagnetic fluids which are responsive to an electromagnetic field, and which contain carbonyl iron; and electroviscous fluids which are responsive to an electric field and which contain silica gel. In the electroviscous fluids, the silica gel is used as the field-responsive solid, not as a dispersant. The electroviscous fluids comprise dry ground silica gel, a surfacant, such as sorbitol sesquioleate, a vehicle such as kerosene, and other ingredients.

U.S. Pat. No. 2,661,596 discloses a composition which is responsive to both electric and magnetic fields. The composition comprises micronized powders of ferrites, which are mixed oxides of various metals. The composition also contains dispersants and thixotropic agents. The patent also discloses the use of silica gel powder in an electric field-responsive fluid, and the use of iron carbonyl in a magnetic field-responsive fluid. There is no suggestion of the use of silica gel in a magnetic field-responsive fluid.

Other patents containing disclosures similar to that of U.S. Pat. No. 2,661,596 are U.S. Pat. Nos. 2,663,809 and 2,886,151.

A brochure published by GAF Corporation of Wayne, N.J., containing the code IM-785, captioned "Carbonyl Iron Powders", contains a discussion of carbonyl iron powders marketed by GAF Corporation. The iron particles are classified as "straight powders", "alloys", "reduced powders", and "insulated reduced powders". An example of a "straight powder" which is listed is an iron powder known as carbonyl "E".

A brief discussion is contained in the brochure concerning magnetic field responsive fluids. It is stated: "The spherically shaped particles of carbonyl iron presumably act like ball bearings in magnetic fluid coupling applications. The smallness of the iron particles gives larger surface area and more contacts than other powders and, hence, better transmission when locked. A lubricant and dispersant are generally required for best results." The brochure contains no disclosure concerning a preferred type of carbonyl iron or dispersant to be employed in a magnetic field responsive fluid.

A publication entitled "Some Properties of Magnetic Fluids", J. D. Coolidge, Jr. and R. W. Halberg, AIEE Transactions, Paper 55-170 (Feb. 1955), pages 149–152, discloses the use of different carbonyl irons in a fluid responsive to a magnetic field. The carbonyl irons disclosed include carbonyl "E" and carbonyl "SF", so-called straight powders, and carbonyl "L", carbonyl "HP", and carbonyl "C", all reduced powders. The article contains no disclosure concerning suitable dispersants, nor conclusions concerning the preference of one carbonyl iron over another in a magnetic field responsive fluid.

A publication entitled "The Magnetic Fluid Clutch" by Jacob Rabinow, NBS Tech. Rep. No. 1213 (1948) [also, Trans. Amer. Inst. Elec. Eng. Preprint 48-238 (1948)]discloses the use of hydrogen reduced iron and carbonyl iron "SF", a "straight" powder as indicated above. The publication contains no disclosure concerning suitable dispersants.

A publication entitled "The Magnetic Fluid Clutch" by S. F. Blunden, The Engineer, 191, 244 (1951) discloses the use of two grades of carbonyl iron, grade "ME" and grade "MC". Grade "ME" is said to be mechanically "hard" and grade "MC" is said to be mechanically "soft". No preference is given for one carbonyl iron over another.

A publication entitled "Further Development of the NBS Magnetic Fluid Clutch", NBS Tech. News Bull., 34, 168 (1950) discloses the use of carbonyl "E" powder in a magnetic fluid. Other compositional information concerning the fluid is also given.

Co-pending application Serial No. 372,293, filed June 27, 1989, assigned to the assignee of the present application, discloses a fluid composition responsive to a magnetic field which comprises a vehicle, and solid magnetic particles suspended in said vehicle. The fluid composition also contains a dispersant. A preferred magnetic particle is insulated, reduced carbonyl iron. A preferred dispersant is a fibrous carbon particle comprising intertwined carbon fibers having a length-to-diameter ratio in the range of about 10:1 to about 1,000:1. Preferably, the fibers have a surface area of about 300 square meters per gram.

SUMMARY OF THE INVENTION

The fluid composition of the present invention comprises a vehicle, solid magnetizable particles suspended in said vehicle, and a silica gel dispersant. Preferably, the magnetizable particles are insulated, reduced carbonyl iron particles. A preferred vehicle is a silicone oil. The composition of the present invention is particularly useful as the dampening fluid in a shock absorber.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 1:
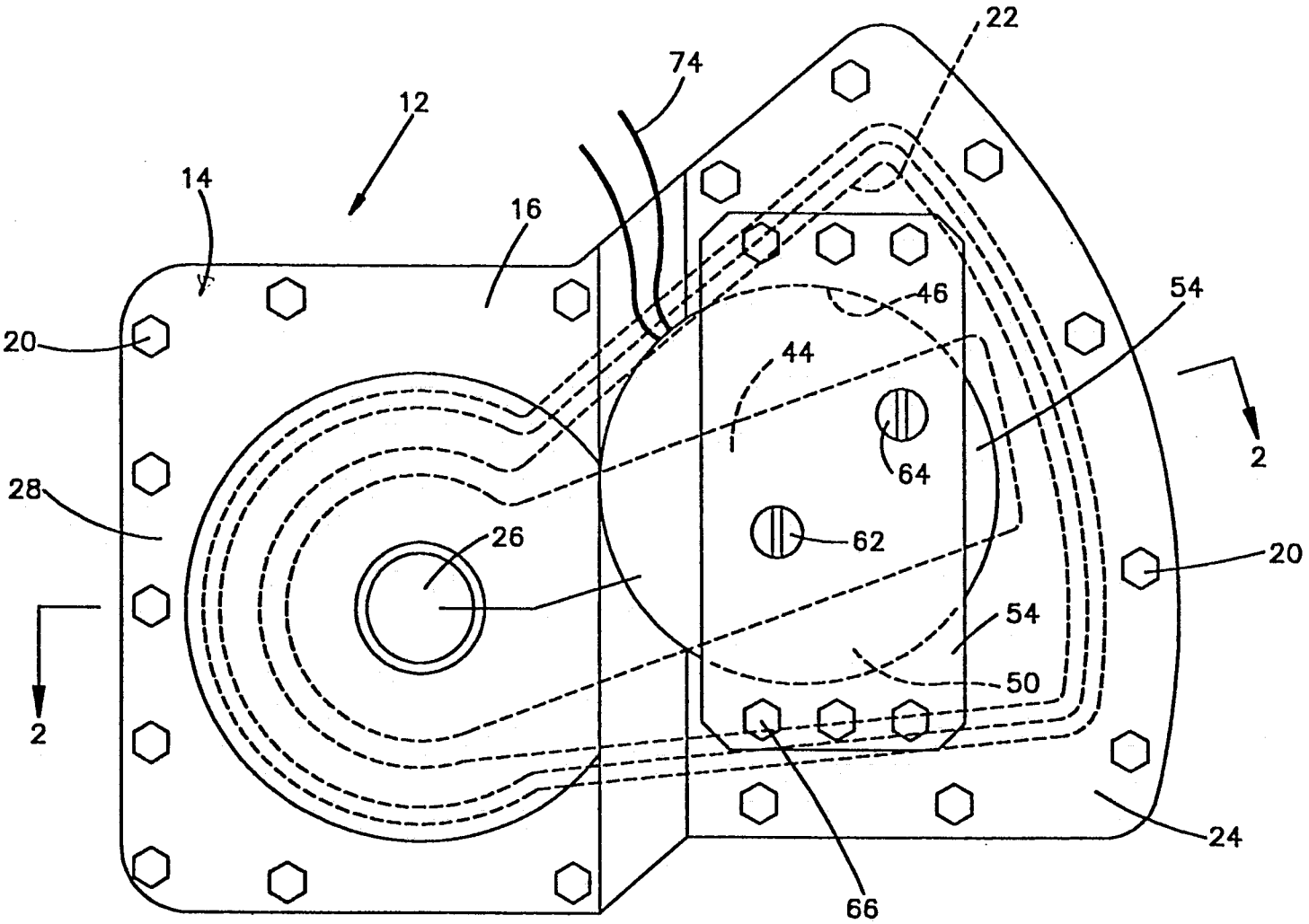
FIG. 1 is a view of an apparatus which uses a rheological fluid in accordance with the present invention.

The fluid composition of the present invention comprises a vehicle, such as mineral oil, silicone oil, or Conoco LVT oil; solid magnetizable particles suspended within the vehicle; and silica gel functioning as a dispersant.

The silica gel is obtained by treating a solution of sodium silicate with an acid. This forms a hydrated silica precipitate in which the water of solution is entrapped. The precipitate is heated at an elevated temperature under reduced pressure to remove the water producing a very porous silicate powder which is the silica gel.

The silica gel may not be necessarily pure silicate, and by way of example, can contain up to about 20% by weight of other oxides, such as $Na_2O$, CaO, and $Al_2O_3$.

Preferably, the silica gel of the present invention is an amorphous silica powder comprising ultrafine particles. The powder has a large surface area, as measured by the BET method, of from about 100 to about 300 square meters per gram. Each particle is highly porous and contains a pore area many times its exterior. The pores are concave and readily absorb large amounts of liquid or vapor. Such materials have found frequent use as dessicants and catalysts. Preferably, the silica gel has an average particle size between about 0.1 microns and about 0.01 microns.

A preferred silica gel is a powder marketed by PPG Industries under the trademark "Hi-Sil 233". This powder is an amorphous silica produced by a chemical reaction in a water solution, from which the powder is precipitated. The powder has an average particle size of 0.019 microns, and a surface area in the range of about 140–160 square meters per gram, typically about 150 square meters per gram, as determined by the BET method. Less than about 0.03% of the powder is retained on a 100 mesh screen. This powder is frequently used as an absorbent carrier and flow conditioner of solids, and for viscosity control of liquids.

Another useful silica gel is "Hi-Sil 250" (trademark PPG Industries). This silica gel is similar to "Hi-Sil 233" but low in sulfate salts.

A preferred magnetizable particle is reduced, insulated carbonyl iron. Other carbonyl iron powders and magnetite also can be used. Powder magnetite ($Fe_3O_4$) is the fully oxidized magnetic oxide of iron, carbonyl iron, or iron-nickel.

Carbonyl iron is manufactured by the decomposition of iron pentacarbonyl $Fe(CO)_5$. This process produces a spherical unreduced particle of very small average particle size. The spherical shape and very small particle size makes carbonyl iron especially useful in a magnetic field-responsive fluid. The unreduced carbonyl iron has what is referred to as an onion-skin structure due to minute carbon deposits in alternating layers. The carbon content is about 1%. Reduction or de-carbonization of the unreduced powder is carried out by exposing the powder to a hydrogen atmosphere, followed by compaction. This destroys the onion-skin structure and produces a composite of randomly arranged minute iron particles. The carbon content of the reduced powder is about 0.075%.

The reduced powders preferably have an insulation coating. The insulation coating prevents particle-to-particle contact. The insulation coating can be any particle-coating agent capable of insulating the carbonyl iron particles and preventing interparticle eddy currents or dielectric leakage. Insulated reduced carbonyl iron particles are electronically non-conductive. Iron oxide can be an insulation coating. The particles are physically soft and compressible. Their shape is spherical. Reduced particles which are also insulated are marketed by GAF Corporation under the designations "GQ-4" and "GS-6". The following Table 1 gives physical and chemical properties for the insulated, reduced powders:

TABLE 1

| GAF Carbonyl Iron Powder Type | Avg. Particle Diameter Microns (Fisher Sub-Sieve Sizer) | Apparent Density g/cm³ | Tap Density g/cm³ | % Fe (Min) | % C (Max) | % O (Max) | % N (Max) |
|---|---|---|---|---|---|---|---|
| GQ-4 | 4–6 | 2.0–3.0 | 3.0–4.0 | 99.0 | 0.1 | 0.3 | 0.1 |
| GS-6 | 3–5 | 1.2–2.2 | 2.2–3.2 | 99.0 | 0.1 | 0.3 | 0.1 |

The data of Table 1 can be found on page 4 of the GAF brochure mentioned above, bearing the identifying code IM-785. The disclosure of the GAF brochure is incorporated herein by reference.

It is believed that the reduced powders have a more random arrangement of minute iron particles than the so-called "straight" powders, and that this results in a lower hysteresis effect than with the "straight" powders. The insulation on the powders enhances the efficiency of the magnetic fluid in reducing parasitic eddy currents around the particles, which eddy currents could adversely affect the magnetic field strength in the fluid.

The vehicle of the composition of the present invention can be any vehicle conventionally employed in a fluid responsive to a magnetic field. Examples of suitable vehicles are set forth in the prior art referenced above. Preferably, the vehicle employed in the present invention is an oil having a viscosity between one and 1,000 centipoises at about 100° F. A preferred vehicle is a silicone oil having a viscosity in the range of about 10–1,000 centipoises at 100° F. Specific examples of suitable vehicles and their viscosities are set forth in the following Table 2:

TABLE 2

| Vehicle | Viscosity |
|---|---|
| Conoco LVT oil | 1.5 centipoises at 100° F. |
| Kerosene | 1.9 centipoises at 81° F. |
| Light paraffin oil | 20 centipoises at 100° F. |
| Mineral oil (Kodak) | 40 centipoises at 100° F. |
| Silicone oil | 700 centipoises at 100° F. |

Silicone oil is compressible. At a pressure of about 20,000 psi, silicone oil has a compressibility of about 9%–9.2%. This makes the composition of the present invention, containing silicone oil as the vehicle, ideal for use in a shock absorber. The compressibility gives the fluid of the present invention a spring-like characteristic. Dampening of the shock absorber is obtained by energizing the carbonyl iron, or other magnetizable particle, in a magnetic field. One effect is a mechanical control, proportionate to the amount of silicone oil used. The other effect is an electrical control. By varying the proportions of materials in the composition of the present invention, a wide range of spring-like and dampening characteristics can be obtained. Thus, the composition of the present invention can be readily optimized for different shock absorber applications.

The proportions of ingredients employed in the composition of the present invention can vary over wide ranges. Particular ratios selected depend upon the application for the composition of the present invention. Basically, the silica gel is employed in an amount effective to disperse the carbonyl iron or other magnetizable particle and to maintain such particles in suspension in the vehicle. The amount of vehicle used is that amount necessary for the vehicle to function as the continuous phase of the composition. Air pockets in the composition should be avoided. The amount of magnetizable particles is a force-transmitting amount defined as that amount necessary to provide an enhanced force-transmitting effect between two members separated by the fluid composition of the present invention. The amount has also been described in the prior art as a binding amount effective to create a seemingly solid mass, or as an amount effective to create a shear resistant medium. In most instances, the amount of carbonyl iron powder or other material responsive to a magnetic field will be essentially the remainder of the composition following the amount of silica gel and vehicle. Preferably, the silica gel to carbonyl iron (or other magnetizable particle) weight ratio is in the range from about 10:90 to about 0.5:99.5. The weight of the vehicle is about 15% to about 50% of the combined weight of the silica gel and carbonyl iron (or other magnetizable particle).

Preferably, the proportions of the present composition are such that the composition of the present invention has thixotropic properties and is mechanically stable in the sense that the composition remains homogeneous for prolonged periods of time.

The small particle size, large surface area to weight ratio, and highly porous structure of the silica gel of the present invention, makes the silica gel an ideal dispersant for the small particles of carbonyl iron or other magnetizable particulate. It is believed that the small particles of carbonyl iron or other magnetizable particulate become mechanically held by the surface structure of the silica gel and thus uniformly dispersed in the vehicle. The silica gel particles when placed in the liquid vehicle, in a dispersing amount, thicken the vehicle impeding settling of the particles. At the same time, they form a thixotropic mixture with the vehicle which has good flow properties when exposed to shear. The viscosity of the thixotropic mixture is relatively independent of temperature. Normally, the moving parts of the apparatus with which the composition of the present invention is used stir the composition effectively so that settling of the particles presents no problem at all. However, if desired, the composition of the present invention can also contain a surfactant. Any surfactant conventionally employed in a field-responsive fluid can be used. Examples of surfactants are: dispersants, such as ferrous oleate or ferrous naphthenate; aluminum soaps such as aluminum tristearate or aluminum distearate; alkaline soaps, such as lithium stearate or sodium stearate, employed to impart thixotropic properties; surfactants such as fatty acids, e.g., oleic acids; sulfonates, e.g., petroleum sulfonate; phosphate esters, e.g., alcohol esters of ethoxylated phosphate esters; and combinations of the above.

Silica gel is very hygroscopic, and the composition of the present invention is preferably moisture free. Accordingly, the silica gel is preferably intensively dried immediately prior to adding it to other ingredients of the composition.

EXAMPLE

The composition of this Example is useful in a rotary shock absorber. In this Example, 99% by weight carbonyl iron and 1% by weight of pre-dried silica gel were mixed together. The carbonyl iron was a reduced, insulated carbonyl iron powder marketed by GAF Corporation under the trade designation "GS-6". The silica gel was "Hi-Sil 233" (trademark PPG Industries). A mixture of 20% by weight of silicone oil having a viscosity of 700 centipoises at 100° F. and 80% by weight of the carbonyl iron and silica gel mixture was then homogenized in a homogenizer for 12–24 hours under vacuum. Intensive mixing in the homogenizer functioned to thoroughly mix the silica gel and carbonyl iron. It also effected thorough wetting of all surfaces of the silica gel and carbonyl iron with silicone oil.

A test apparatus was constructed to determine the coupling load characteristics of the composition under various conditions. The test apparatus is similar in construction to the shock absorber disclosed in co-pending application Serial No. 339,126, filed Apr. 14, 1989, assigned to the assignee of the present application. The test apparatus is illustrated in the drawings of this application.

Figure 2:
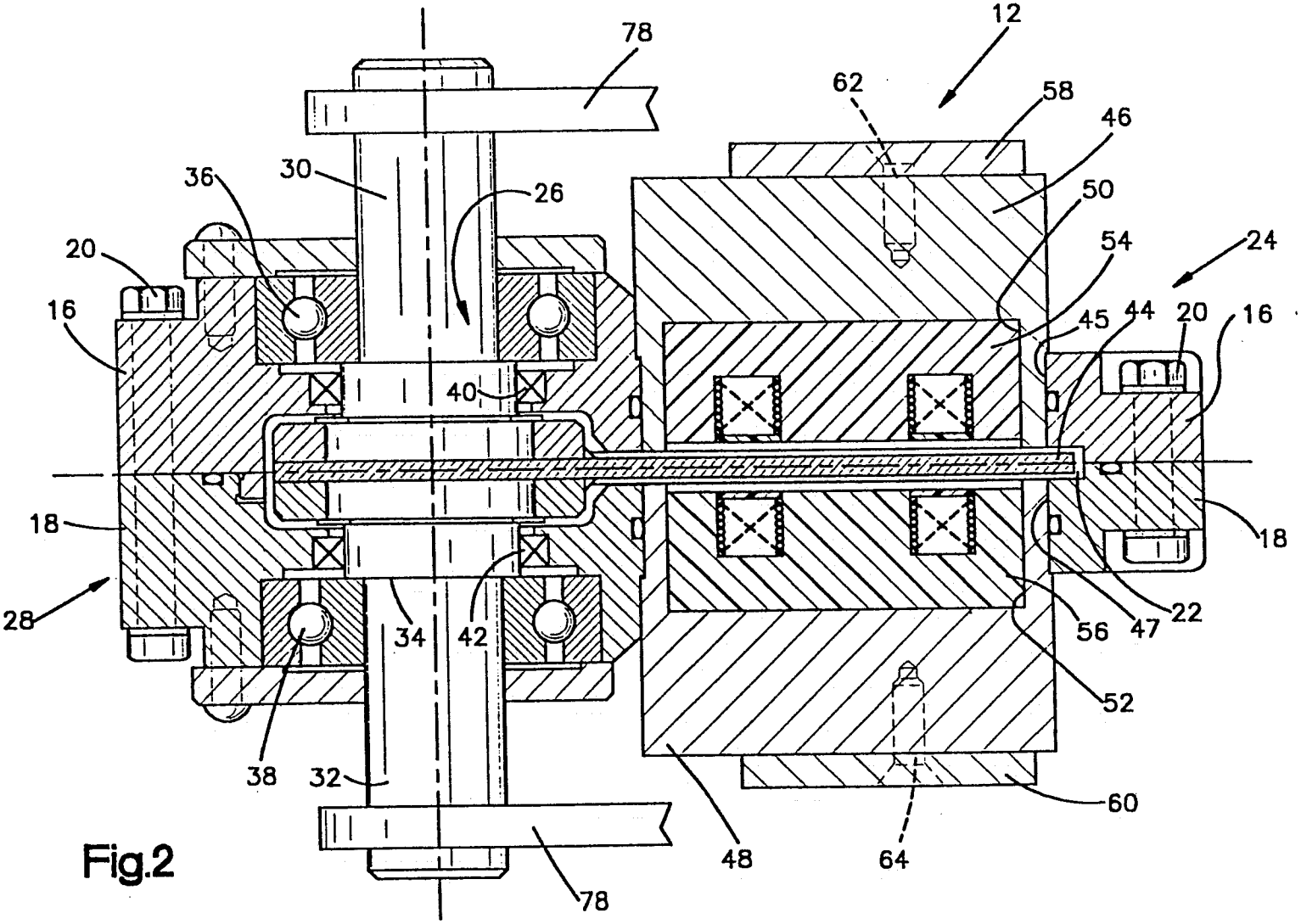
FIG. 2 is a sectional view taken along line 2—2 of FIG. 1.

Referring specifically to FIGS. 1 and 2, the test apparatus 12 comprises a non-magnetic aluminum housing 14. The housing 14 comprises first and second housing sections 16 and 18 (FIG. 2) which are fastened together by bolts 20. The housing sections 16, 18 define a fluid chamber 22 (FIG. 2) in the right end portion 24, as viewed in the drawings, of the housing. A shaft 26 extends through the left end portion 28, as viewed in the drawings, of the housing 14. The shaft 26 has shaft end sections 30 and 32 (FIG. 2) and a shaft center section 34. The shaft 26 rotates in bearing assemblies 36 and 38. Seals 40, 42 prevent fluid leakage along the shaft 26.

Figure 3:
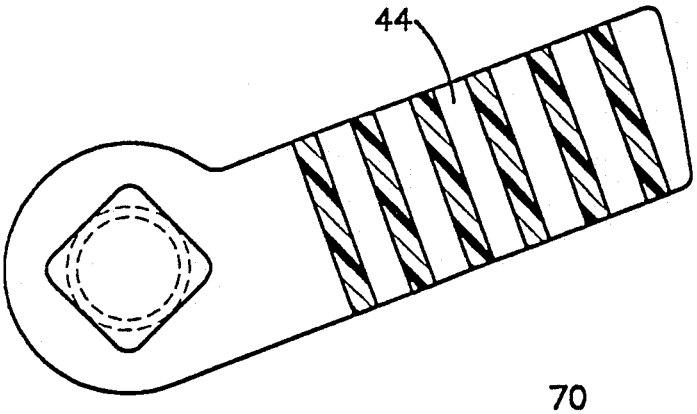
FIG. 3 is a plan view of a blade used in the apparatus of FIG. 1.

The center section 34 of the shaft 26 has a square configuration. A rotor blade 44 is fixed to the center section 34 so as to rotate with the shaft. The rotor blade 44 has a configuration as shown in FIG. 3. It extends radially from the shaft center section 34 into the fluid chamber 22.

The right-end portion 24 of the housing 14 has an opening 45 in which holder 46 for an electromagnet 54 is located and an opening 47 in which a holder 48 is located for an electromagnet 56. The holders 46, 48 have chambers 50, 52, respectively, in which the electromagnets 54, 56 are located.

The holders 46, 48 are secured to the housing sections 16 and 18 by means of brackets 58, 60, respectively. Screws 62, 64 hold the coil holders 46, 48 to the brackets 58, 60, respectively. Screws 66 (FIG. 1) hold the brackets 58, 60 to the housing sections 16, 18. The electromagnets 54, 56 can be chemically bonded to the holders 46, 48 or alternatively fastened to the holders by screws not shown. The non-magnetic material of the housing 12 and holders 46, 48 minimizes leakage of magnetic flux from the electromagnets 54, 56.

Figure 4:
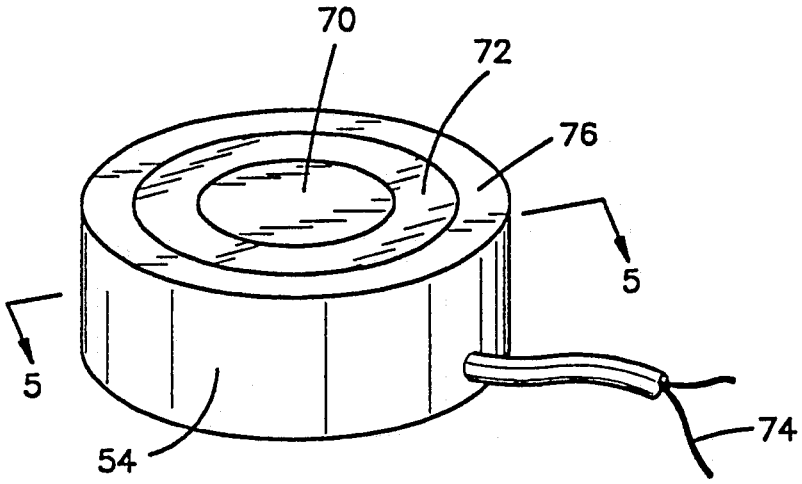
FIG. 4 is a perspective view of an electromagnet used in the apparatus of FIG. 1.
Figure 5:
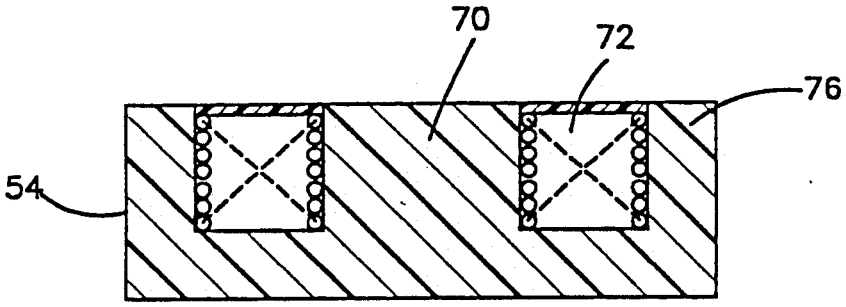
FIG. 5 is an enlarged sectional view taken along line 5—5 of FIG. 4.
Figure 6:
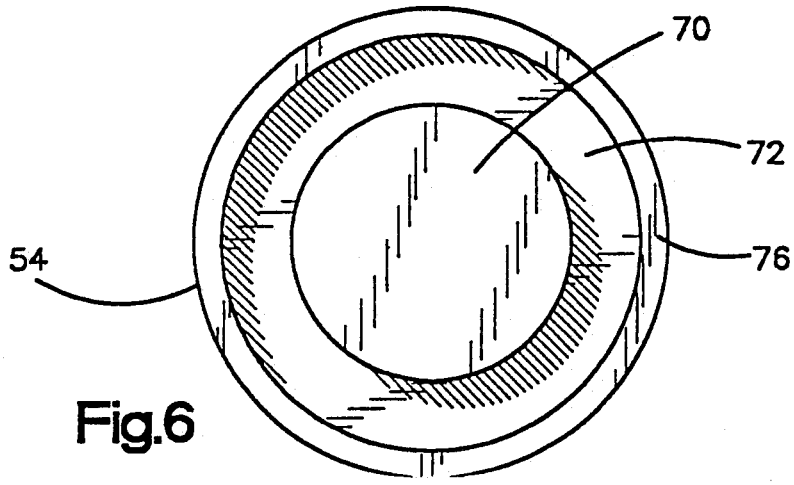
FIG. 6 is a plan view of the electromagnet of FIG. 4.

FIGS. 4, 5 and 6 show details of the electromagnets 54, 56. Each electromagnet 54, 56 comprises a soft iron core 70 around which an electrical coil 72 is wound. The electrical coil 72 is covered with an encapsulating material such as an epoxy. Each of the electromagnets 54, 56 has a pair of wire ends 74. An outer soft iron pole 76 extends around the coil 72.

The electromagnets 54, 56 are mounted so that the poles of the electromagnets 54 face the poles of the electromagnet 56. The rotor blade 44, and the fluid chamber 22, are positioned between the electromagnets 54, 56. The spacing between one electromagnet and the blade is about 0.25 millimeters. The blade thickness is about two millimeters. In the present Example, the center core 70 of each electromagnet has a diameter of 1.50 inches. The outside diameter of each electromagnet is three inches. The outer pole 76 has a radial thickness of 0.1875 inches. Each electromagnet coil 72 has 894 wire turns.

When the coils 54, 56 are energized, each electromagnet generates its own magnetic field. Lines of magnetic flux are established between the two electromagnets. The lines of magnetic flux pass through the fluid in the fluid chamber 22 and through the rotor blade 44. These lines of magnetic flux act on the fluid in the fluid chamber 22 to vary the resistance to movement of the rotor blade 44 in the fluid.

To test the coupling strength of the magnetic fluid of the present invention, when exposed to a magnetic field, the shaft 26 was connected by means of arms 78 (FIG. 2) to a torque motor (not shown). The torque motor was associated with a means for measuring torque. Different currents were applied to the electromagnets 54, 56. The torque required to turn the blade in the magnetic fluid in chamber 22, under the influence of the magnetic field, was measured. The results of the test are shown in FIG. 7.

Figure 7:
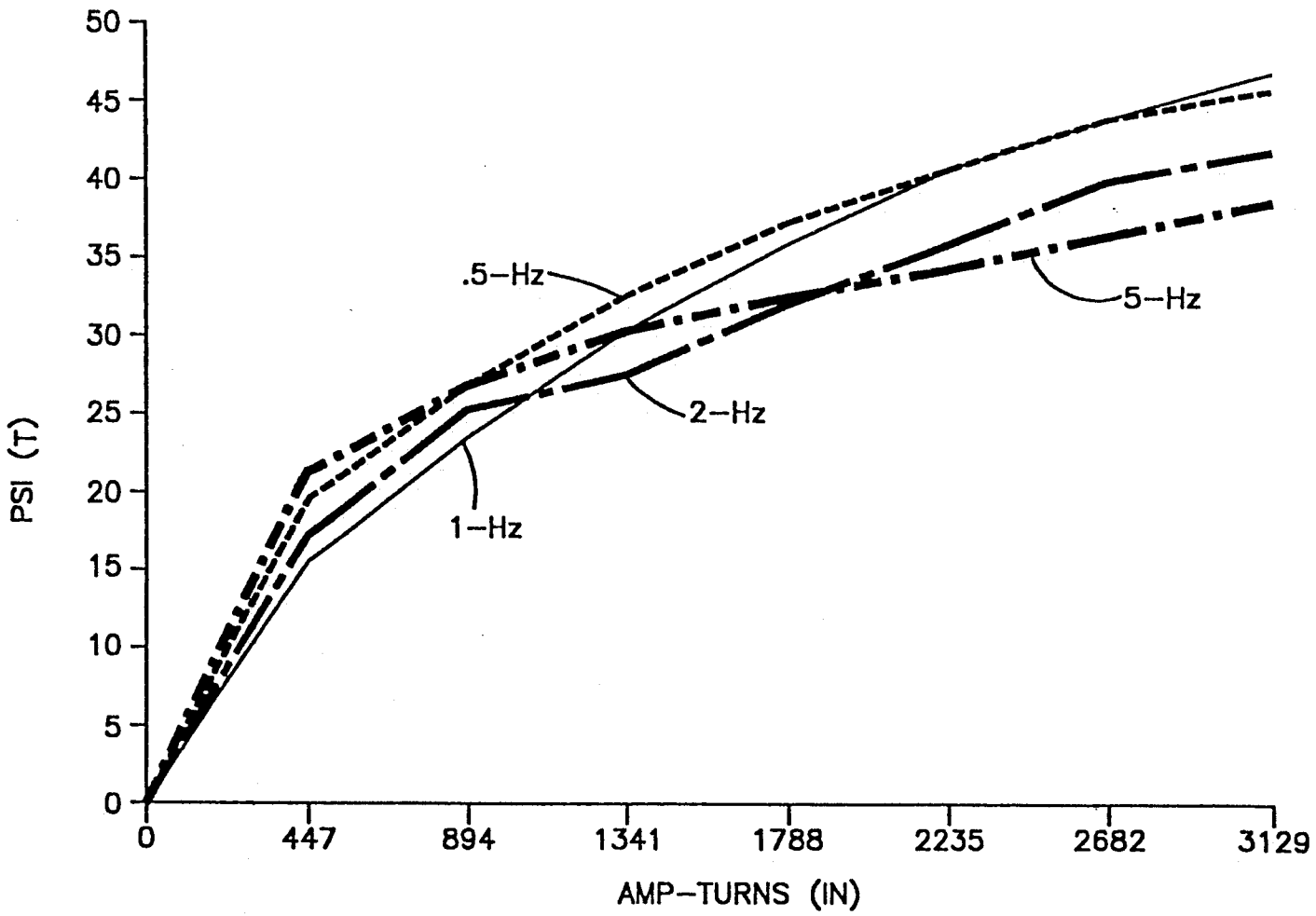
FIG. 7 is a graph illustrating operational characteristics of the apparatus of FIG. 1.

Referring to FIG. 7, the current flow in amp-turns is plotted along the X axis. The current employed varied from zero to about three and one-half amps (3129 amp turns). The resistance to turning of the blade 44 in terms of pounds per square inch is given along the Y axis and varied from about zero to about 50 psi. This measurement was obtained by dividing the pounds of torque required to turn the blade by the blade surface area exposed to the magnetic responsive fluid in chamber 22. Also measurements were taken at different frequencies of oscillation varying from 0.5 Hertz to 5 Hertz.

As shown, the resistance to turning at zero current was nearly zero indicating excellent lubricating properties of the composition of the present invention. The resistance to turning increased rapidly with increase in current flow up to about 38–48 pounds per square inch at 3129 amp-turns (about 3 ½ amps). The measurements were taken at different frequencies and all measurements followed quite similar curves indicating that the composition of the present invention is relatively frequency insensitive.

In contrast, a conventional magnetic field responsive fluid would require currents of substantially greater magnitude or a substantially greater number of coil windings, to achieve equivalent coupling strength. A conventional magnetic field responsive rheological fluid might provide a coupling strength of less than one pound per square inch with a magnetic field generated with a current flow of about 3129 amp-turns. Thus, the rheological fluid of the present invention permits the construction of very compact, magnetic field responsive fluid devices having a relatively high coupling strength.

The composition of the present invention remains stable against settling or separation by centrifugal forces. In addition, the composition exhibits excellent dampening and spring-like characteristics considered suitable for a vehicle suspension system.

From the above description of a preferred embodiment of the invention, those skilled in the art will perceive improvements, changes and modifications. Such improvements, changes and modifications within the skill of the art are intended to be covered by the appended claims.

Having described a preferred embodiment of the invention, I claim:

1. A rheological fluid composition which is responsive to a magnetic field, which fluid composition comprises a mixture of carbonyl iron and silica gel comprising about 0.5–10% by weight of said silica gel and about 90% to 99.5% by weight of said carbonyl iron; and a vehicle in the amount of about 15%–50% of the weight of said mixture.

2. The fluid composition of claim 1 wherein said silica gel has a surface area, as measured by the BET method, of about 100 to about 300 square meters per gram of silica gel.

3. The fluid composition of claim 2 wherein said silica gel has average particle size diameter less than about 0.1 microns.

4. The fluid composition of claim 3 wherein less than 0.03 percent by weight of the silica gel is retained on a 100 mesh screen.

5. The fluid composition of claim 3 wherein said vehicle has a viscosity in the range of about one-1,000 centipoises at 100° F.

6. The fluid composition of claim 5 wherein said vehicle is silicone oil having a viscosity in the range of about 10–1,000 centipoises at 100° F.

7. The fluid composition of claim 1 wherein said carbonyl iron is an insulated, reduced carbonyl iron.

8. The fluid composition of claim 1 wherein said vehicle is silicone oil.

9. A rheological fluid composition which is responsive to a magnetic field comprising:

a vehicle;

a solid magnetizable carbonyl iron particulate suspended in said vehicle;

a silica gel dispersant, said silica gel having a surface area, as measured by the BET method, of about 100 to about 300 square meters per gram of silica gel, and an average particle size diameter wherein less than 0.030 percent by weight is retained on a 100 mesh screen;

the ratio of silica gel to carbonyl iron being about 0.5%–10% by weight silica gel to about 90%–99.5% by weight carbonyl iron;

said vehicle being about 15%–50% by weight of the combination of silica gel and carbonyl iron.

10. The fluid composition of claim 9 wherein said magnetizable particulate is an insulated, reduced carbonyl iron.

11. The fluid composition of claim 10 wherein said vehicle is silicone oil.

* * * * *